US005554071A

United States Patent [19]

Peltola et al.

[11] Patent Number: 5,554,071

[45] Date of Patent: Sep. 10, 1996

[54] AIR-CHANGE SYSTEM FOR A MULTI-STOREY BUILDING

[75] Inventors: Heikki Peltola, Hollola; Markku Saloranta, Lahti, both of Finland

[73] Assignee: Abb Flakt Oy, Helsinki, Finland

[21] Appl. No.: 307,824

[22] PCT Filed: Apr. 1, 1992

[86] PCT No.: PCT/FI92/00095

§ 371 Date: Oct. 31, 1994

§ 102(e) Date: Oct. 31, 1994

[87] PCT Pub. No.: WO93/20388

PCT Pub. Date: Oct. 14, 1993

[51] Int. Cl.[6] ..... F24F 3/044; F24F 7/007

[52] U.S. Cl. ..... 454/338; 454/251; 454/906

[58] Field of Search ..... 454/284, 305, 454/307, 338, 251, 252, DIG. 906

[56] References Cited

U.S. PATENT DOCUMENTS

| | | | |
|---|---|---|---|
| 1,052,450 | 2/1913 | Berglund | 454/252 |
| 2,282,210 | 5/1942 | Plum | 454/338 X |
| 5,247,990 | 3/1994 | Renz et al. | 454/338 X |

FOREIGN PATENT DOCUMENTS

| | | | |
|---|---|---|---|
| 388593 | 7/1989 | Austria . | |
| 584874 | 10/1954 | Canada | 454/252 |
| 0374527 | 11/1989 | European Pat. Off. . | |
| 2160012 | 6/1973 | Germany . | |
| 2363081 | 7/1974 | Germany . | |
| 2350447 | 4/1975 | Germany . | |
| 2748772 | 5/1979 | Germany . | |
| 2915392 | 2/1981 | Germany . | |
| 121335 | 4/1980 | Japan | 454/251 |
| 7304523 | 5/1975 | Sweden . | |
| 465182 | 8/1991 | Sweden . | |

*Primary Examiner*—Harold Joyce
*Attorney, Agent, or Firm*—Fitch, Even, Tabin & Flannery

[57] ABSTRACT

A ventilation system for a multi-storey building, which system comprises a ventilation apparatus mounted on a roof and provided with fans for generating an inlet air flow and a distributing channel for supplying the inlet air flow to various intermediate levels of the building. A service shaft of the building serves as an inlet air flow channel, which shaft forms a flow path for the inlet-air flow directed from the fans downwards, whereby the service shaft has deflecting means for passing a part of the air flow to each intermediate level of the building.

11 Claims, 3 Drawing Sheets

FIG. 4
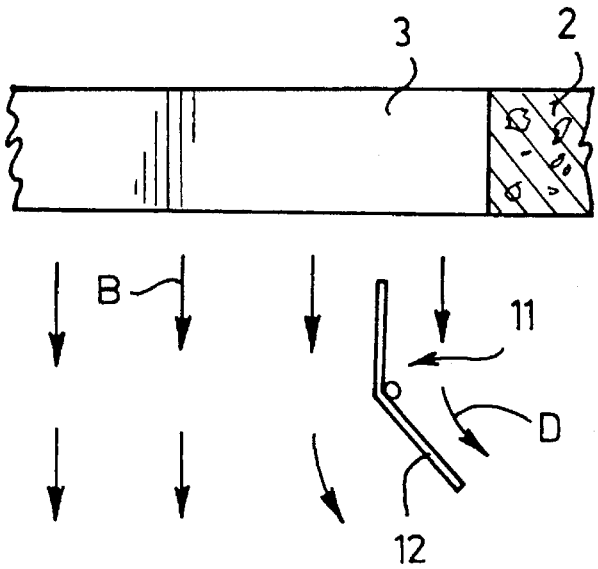
FIG. 5
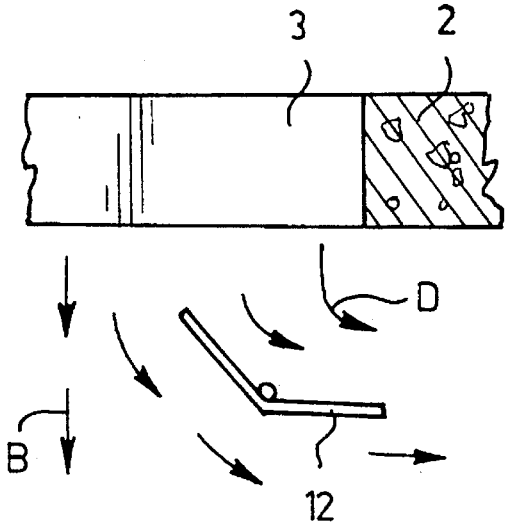
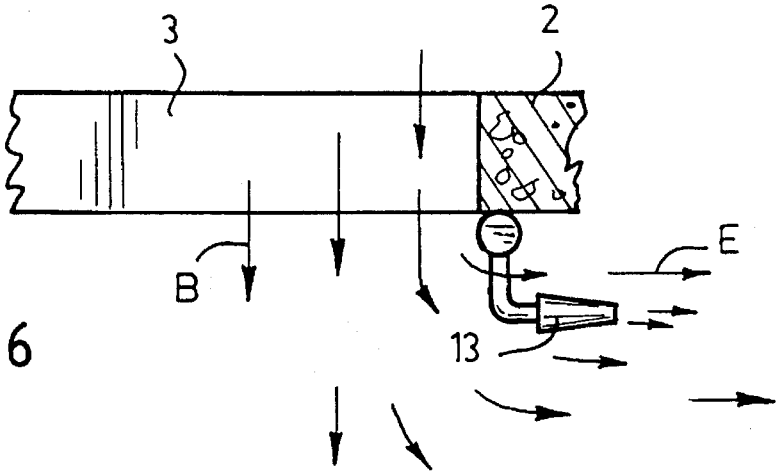
FIG. 6

AIR-CHANGE SYSTEM FOR A MULTI-STOREY BUILDING

BACKGROUND OF THE INVENTION

This invention relates to a ventilation system for a multi-storey building, which system comprises an apparatus mounted on the roof of the building with fans for generating an inlet air flow and a distributing channel for supplying the inlet air flow to various intermediate levels of the building.

In high buildings, in which indoor air is warmer than outdoor air, a pressure difference arises between the upper and lower part of the building. Since buildings are not airtight, air leaks through the constructions from the upper part of the building outwards and from the lower part inwards. Inside the building the air flows from below upwards.

Because of leaks, the lower part of the building is cold and draught often appears therein. In the upper part it is easily hot and if the humidity of the indoor air is clearly higher than the humidity of the outdoor air, leaking air may condense to water in the constructions. Impurities are spread by the internal air flows of the building.

These drawbacks can be prevented by constructing the intermediate levels as airtight as possible in the building. In residential and office buildings, for instance, the building has thus been successfully divided into parts independent of each other, within which the effects of the pressure difference can be eliminated by conventional air-conditioning techniques thanks to the slightness of the pressure difference.

In industrial buildings again, in which there are many big passages for production equipment, manholes holes and service shafts etc. through the levels, it would be extremely expensive and difficult, if not directly impossible, to build airtight levels.

If there are no intermediate levels in the building, temperature differences between the upper and lower part of the building can be equalized by means of strong air jets, which extend from the vicinity of the roof nearly to the plane of the floor, bring along air from the upper part of the building and mix it effectively. Such a system is known from Finnish Patent no. 56 714.

Such a system cannot be used in multi-storey buildings, even though the intermediate levels were air permeable, such as plane grates, because areas with strong air jets are not suited for working places.

If there are only a few intermediate levels, pressure and temperature differences have been equalized by means of axial-flow fans mounted on the levels, which fans blow air from an upper level downwards. Still, they take up valuable floor space, cause noise problems, consume electric power and are relatively ineffective with respect to balancing the temperature, because the air from the fan is in a strong rotating motion. The air does not flow as a jet to a lower level, but spreads along the ceiling of the lower level, whereby no mixing to balance temperatures occurs.

So, temperature and pressure differences in high multi-storey buildings generally tend to be reduced in such a way that a maximum part of the ventilation air is passed through channels to the lower part of the building and only a minimum air flow necessary for the air quality to the upper part. Pressure differences can thus be slightly equalized, which has some effect on leaks and temperature differences, but the air flow required for the ventilation generally is quite insufficient for an effective pressure balancing. The channels take up space in the building, to build them causes costs and to locate them in the building is difficult. An effective air distribution by means of conventional air distributing devices to often wide levels seldom succeeds without distributing channels, which additionally increases the costs. A problem of its own is caused by the regulation. A pressure and temperature difference in a building depends on the temperature difference between the indoor and outdoor air, according to which it should be possible to regulate the ratio of the inlet air flows of the upper and lower part of the building. This is not possible in practice because of the high costs due to the great amount of both air distributing and regulating devices. The result of the above is that e.g. the lower part of the building is subjected to underpressure in winter and to overpressure in summer. The pressure ratios are opposite in the upper part and the air quality is often bad.

SUMMARY OF THE INVENTION

The object of this invention is to provide a ventilation system avoiding the above drawbacks and enabling a decrease of the costs and the need of space of the ventilation apparatus, an improvement of the air distribution and so of the air quality as well as an improvement of the adjustability of the system. This object is achieved by means of a ventilation system according to the invention, which system is characterized in that a service shaft of the building or a similar space extending vertically through the building and opening to the intermediate levels serves as an inlet air flow channel, forming a flow path for the inlet air flow directed from the fans downwards, and that the service shaft has deflecting means for passing a part of the air flow to each intermediate level of the building.

The invention is based on the idea that a service shaft of the building is used as an inlet air channel and that the ventilation apparatus is positioned up on the service shaft in order that the air can be blown by fans belonging to the ventilation apparatus anyhow as a big and strong air jet along the service shaft down into the building. Then the service shaft acts as a channel for the inlet air and no other channel is needed. This decreases the costs considerably, because the costs of building a special inlet air channel and the costs of the necessary building space required are omitted.

In industrial buildings, such as boiler plants, there is generally a vertical service shaft covered by easily removable grates, which shaft extends through the building. Because it shall be possible any time to lift machines to be maintained or repaired, spare parts, machines and accessories necessary for repairs, etc. through the shaft to various levels, no working positions, stocks or other functions are placed at the service shaft. In buildings like this, as in most other buildings, the ventilation apparatus is generally positioned on the roof of the building for reasons of air quality, effective space utilization etc. To realize the invention, the ventilation apparatus and the service shaft are just to be arranged in such a manner with respect to each other that the service shaft replaces the conventional separate channel system required for the inlet air flow, through which system the inlet air is passed to the various storeys of the building.

The fans of a boiler plant, for instance, are generally axial-flow fans, from which the air starts in a strong rotating motion. When entering into free space the air jet would therefore spread quickly sidewards and the Jet would be quickly retarded and would not extend very far downwards.

The influence of the rotating motion can be considerably reduced if the service shaft is located in a corner of the building, in which case the walls prevent the flow from widening in two directions. Moreover, the jet extends considerably farther under the influence of the so-called Coanda phenomenon: the jet is subjected to an underpressure of the size of about the dynamic pressure compared to the surrounding air so that the jet is kept together by the pressure difference. In addition, a mixing of the surrounding air, which retards the jet most strongly, is prevented in two directions.

If the building in question is high, a turbulent air flow can prevent the air jet from extending down to the lower part of a deep service shaft. The air jet could be straightened by means of a set of guide vanes, the costs of which are, however, disproportionate because of the complicated shape, nearly as high as those of a fan without a motor. A rotating motion can still be stopped practically without costs in a very simple manner.

An embodiment of the system according to the invention is characterized in that the ventilation apparatus comprises at least two axial-flow fans mounted adjacent to each other and generating at least two parallel turbulent flows braking each other and forming an inlet air flow directed downwards. The turbulent flows from the fans brake then each other effectively. In addition, the moment of the quantity of motion of each whirl is considerably smaller than that of one big, in the same way as the diameter of the whirl, so that the rotating motion is retarded more quickly when the whirl is widening. The costs rise perhaps a little, but it is compensated for by an increase of the operational reliability. Even if one fan gets broken, the plant continues to operate with reduced effect.

A preferable embodiment of the system according to the invention is characterized in that an air flow directing unit consisting of fans and a directing device is mounted at least at one intermediate level in the service shaft to guide the inlet air flow in the direction of the service shaft. By means of this construction, it is possible to control the air distribution to the various levels of the building in a suitable manner, as well as the air distribution over the whole area of the level equally or in a desired manner.

BRIEF DESCRIPTION OF THE DRAWINGS

The invention will below be described more accurately referring to the enclosed drawings, in which FIGS. 4 and 5 show a part of a service shaft of the building with air flow deflecting means from the side in two different regulating positions, and FIG. 6 shows a part of the service shaft provided with distributing nozzles from the side.

DESCRIPTION

Figure 1:
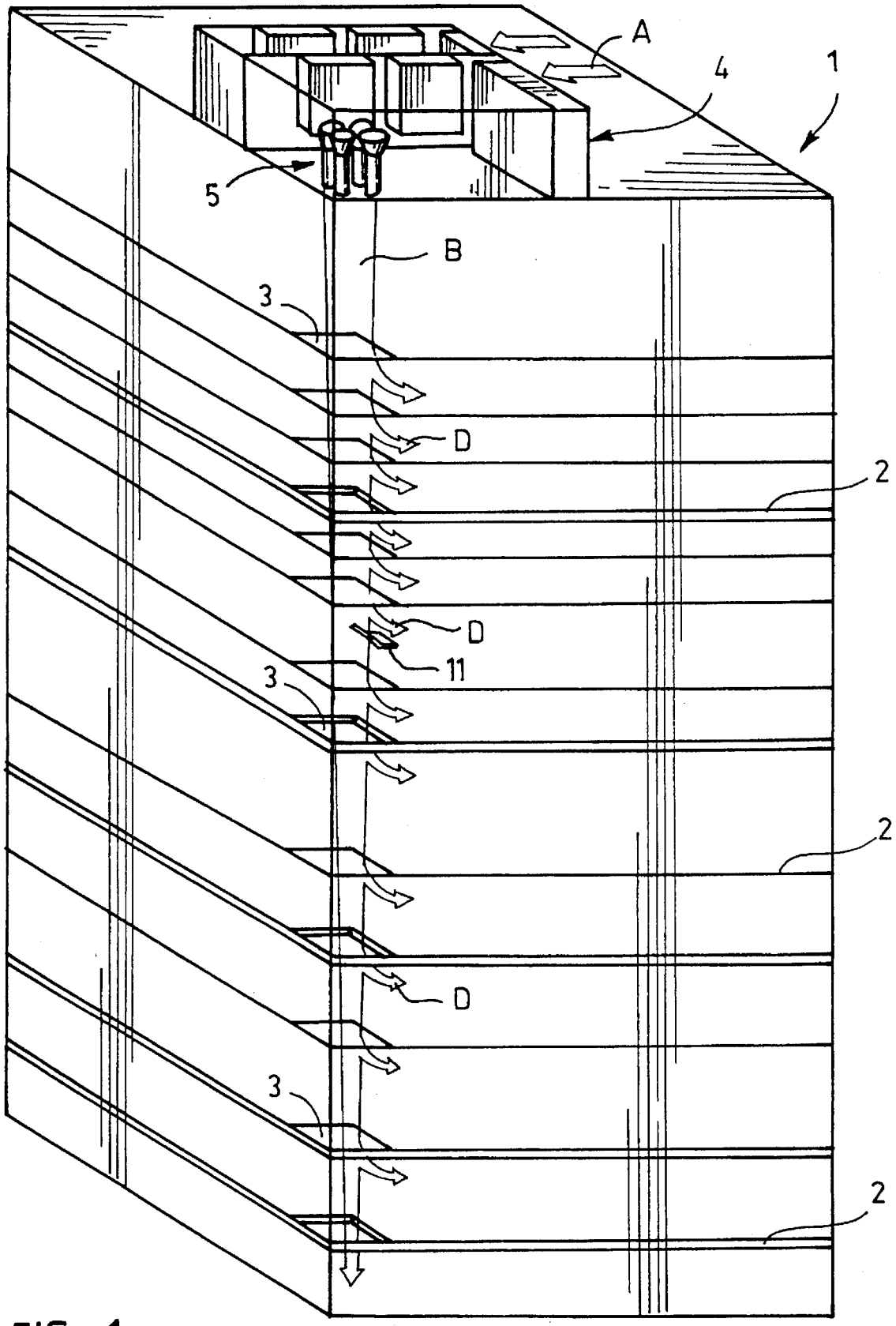
FIG. 1 shows schematically a building and a ventilation system mounted therein, which conforms to an embodiment of the invention.
Figure 2:
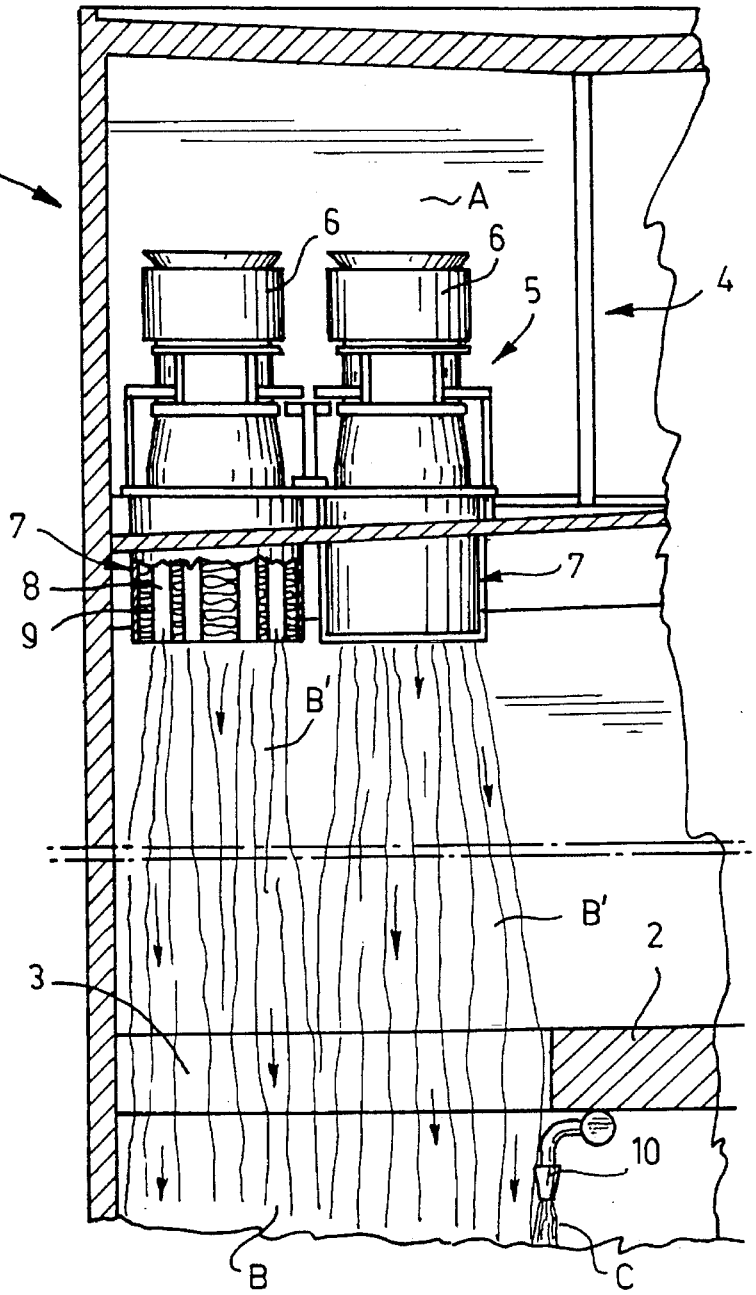
FIGS. 2 and 3 show a fan unit of a ventilation apparatus from the side and a cross-section of an air flow generated, respectively.

FIG. 1 of the drawings shows a multi-storey building 1, in one corner of which there is a vertical service shaft 3 extending through various storeys (intermediate levels) 2 of the building from top to bottom. A ventilation apparatus 4 comprising a fan unit 5 is mounted on the roof of the building. The service shaft can be covered by easily removable grates at the storeys.

The fan unit comprises in this example four axial-flow fans 6 mounted symmetrically adjacent to each other. The fans suck outdoor air A through treatment devices of the ventilation apparatus and blow an inlet air flow B directed downwards into the service shaft.

Figure 3:
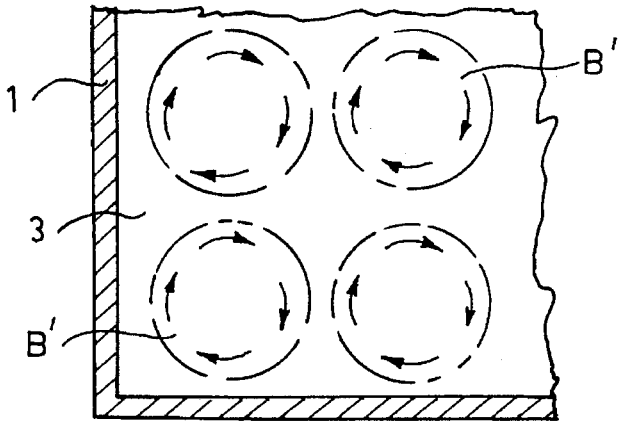

The fans generate four parallel turbulent flows B' directed downwards and braking each other, which together form the inlet air flow B, as shown in FIG. 3.

On the outlet side of each fan is mounted an equalizing chamber 7, in which a through channel is divided by means of separation walls 8 into small flow channels 9, the length of which is great compared with the breadth. The separation walls are made of a sound-absorbing material so that the equalizing chamber serves as a sound dampener.

Nozzles 10 generating support jets C directed downwards are mounted at some storeys at the edges of the service shaft, which nozzles secure that the inlet air flow B is kept together and in a right direction. In very high buildings the air flow can be brought down by placing a unit consisting of fans and equalizing chambers, similar to the one placed on the roof, also on one intermediate level or on several levels.

According to experience, the air jet can be caused to extend from the highest storey to the lowest in a building higher than 70 meters by means of the system described. The air flow moving with the jet is multiple compared to the inlet air flow, because the high-speed air of the Jet brings along surrounding air from the upper part of the building. Pressure balancing is thus very effective.

Deflecting means 11 are mounted at each storey in the service shaft, which means at a storey deflect a part of the inlet air flow to the area of the storey. The deflecting means are in this embodiment formed of plates 12 pivotally mounted in bearings, which plates extend into the air flow. In winter the plates are in a vertical position in the upper storeys, whereby only a small part D of the air flow is deflected to the highest storeys, as presented in FIG. 4. In summer the plates are turned to a horizontal position indicated by broken lines, whereby a greater part D of the air jet is deflected to the highest storeys, as presented in FIG. 5. In the lower part of the building the function is opposite and in the middle part the plates can mostly be fixed. The control of the position can take place on the basis of the outdoor temperature.

Pressure ratios between the storeys can thus be controlled relatively exactly without increasing the air flow of the fans.

A row of horizontally blowing high-speed nozzles 13 is mounted at each storey at the edge of the service shaft, which nozzles draw air E from the vertical flow and blow it to the level, as shown in FIG. 6. By the choice of nozzle size, air speed therein, blowing direction and suitable location, the air can be caused to spread to the levels in a desired manner. The influence of the outdoor temperature on the pressure ratios of the building can be eliminated by adjusting the impulse of the nozzles in manners described in Finnish Patent 66 484, for instance.

The air flow of the nozzles is small compared to the air flow impelled by the nozzles, so that the power consumption is moderate. They can be positioned at the edge of the service shaft, and thus, they do not impede the use of the shaft.

The description above is only intended to illustrate the idea of the invention. As to the details, the system of the invention can vary within the scope of the claims. The elements described can be combined in many different ways and systems with slightly different properties can be provided. The invention can also be applied to an air-conditioning plant. Instead of the service shaft, some other free space of the building extending vertically through it and being in connection with the intermediate levels can be used.

We claim:

1. A ventilation system for a multi-storey building having intermediate levels and a roof, said system comprising:

a ventilation apparatus mounted on the roof of the building with fans for generating a directed inlet air flow; and a ductless service shaft extending vertically through the building which is formed by vertically spaced opening in each level of the building, said service shaft forming a flow path directed downwards from the fans wherein said service shaft permits surrounding air to be brought along from upper ones of said intermediate levels to lower ones of said intermediate levels, and wherein said service shaft serving as an inlet air flow channel having deflecting means for passing a part of the air flow to each of said intermediate levels of said building.

2. A system according to claim 1, wherein the service shaft is located in a corner of the building.

3. A system according to claim 1 wherein the ventilation apparatus comprises at least two axial-flow fans mounted adjacent to each other, which generate at least two parallel turbulent flows braking each other and forming the inlet air flow directed downwards.

4. A system according to claim 3 wherein additionally directing means for the inlet air flow are mounted after the fans to direct the inlet air flow in the direction of the service shaft.

5. A system according to claim 4 wherein said additionally directing means is a support jet mounted at least at one intermediate level in the service shaft to direct the inlet air flow in the direction of the service shaft.

6. A system according to claim 1 wherein the deflecting means comprises deflecting plates mounted at desired intermediate levels in the service shaft, said deflecting plates being adjustable between a vertical position and a horizontal position such that the positions of said deflecting plates control the amount of air flow entering said intermediate levels.

7. A system according to claim 1 wherein the deflecting means are formed by distributing nozzles parallel with the intermediate levels and mounted at desired intermediate levels at the edge of the service shaft, which nozzles take air from the inlet air flow and blow it over the intermediate level.

8. A system according to claim 1 comprising a flow equalizing part mounted in the service shaft after the fans, which flow equalizing part forms a number of adjacent flow channels separated by separation walls to dampen the turbulence of the inlet air flow and to equalize the flow.

9. A system according to claim 8 wherein the separation walls comprise a sound-absorbing material.

10. A system according to claim 4 wherein the directing means are formed by nozzles mounted at a desired intermediate level at the edge of the service shaft, which nozzles generate downwards blowing support jets parallel with the service shaft.

11. A system according to claim 2, wherein the ventilation apparatus comprises at least two axial-flow fans mounted adjacent to each other, which generate at least two parallel turbulent flows braking each other and forming the inlet air flow directed downwards.

* * * * *